US007392008B2

(12) United States Patent
Takahashi

(10) Patent No.: US 7,392,008 B2
(45) Date of Patent: Jun. 24, 2008

(54) ELECTROPHOTOGRAPHIC IMAGE FORMING METHOD AND APPARATUS

(75) Inventor: Yutaka Takahashi, Setagaya (JP)

(73) Assignee: Ricoh Company Limited, Tokyo (JP)

( * ) Notice: Subject to any disclaimer, the term of this patent is extended or adjusted under 35 U.S.C. 154(b) by 70 days.

(21) Appl. No.: 11/418,219

(22) Filed: May 5, 2006

(65) Prior Publication Data

US 2006/0269335 A1 Nov. 30, 2006

(30) Foreign Application Priority Data

May 27, 2005 (JP) ..... 2005-155474

(51) Int. Cl.
*G03G 21/00* (2006.01)

(52) U.S. Cl. ..... 399/346; 399/101

(58) Field of Classification Search ..... 399/101, 399/302, 308, 343, 346
See application file for complete search history.

(56) References Cited

U.S. PATENT DOCUMENTS

| | | | | |
|---|---|---|---|---|
| 5,510,886 | A | 4/1996 | Sugimoto et al. | |
| 6,505,024 | B2 * | 1/2003 | Kayahara et al. | 399/302 |
| 6,562,529 | B1 * | 5/2003 | Kojima et al. | 399/308 X |
| 6,835,770 | B1 | 12/2004 | Tanimura et al. | |
| 2002/0037400 | A1 * | 3/2002 | Fujiwara et al. | 428/330 |
| 2003/0215269 | A1 | 11/2003 | Shin et al. | |
| 2004/0136763 | A1 | 7/2004 | Murakami et al. | |
| 2005/0074264 | A1 | 4/2005 | Amemiya et al. | |
| 2005/0084271 | A1 | 4/2005 | Koike et al. | |
| 2005/0164108 | A1 | 7/2005 | Murakami et al. | |

FOREIGN PATENT DOCUMENTS

| | | |
|---|---|---|
| JP | 59-50475 | 3/1984 |
| JP | 2-213881 | 8/1990 |
| JP | 9-34276 | 2/1997 |
| JP | 10-254295 | 9/1998 |
| JP | 2000-019858 | 1/2000 |
| JP | 2003-29550 | 1/2003 |

* cited by examiner

*Primary Examiner*—Sandra L Brase
(74) *Attorney, Agent, or Firm*—Oblon, Spivak, McClelland, Maier & Neustadt, P.C.

(57) ABSTRACT

An image forming apparatus including an image bearing member; a charger for charging the image bearing member; a light irradiating device for irradiating the charged image bearing member to form an electrostatic image; a developing device for developing the electrostatic image to form a toner image; a primary transfer device for transferring the toner image to an intermediate transfer medium; a secondary transfer device for transferring the toner image to a receiver; a first cleaning device for cleaning the image bearing member; a second cleaning device for cleaning the intermediate transfer medium; a first lubricant applicator for applying a first lubricant to the image bearing member; and a second lubricant applicator for applying a second lubricant to the intermediate transfer medium such that the surface has a second static friction coefficient higher than the first static friction coefficient.

19 Claims, 3 Drawing Sheets

$$SF1=\frac{(MXLNG)^2}{AREA}\times\frac{\pi}{4}\times 100$$

$$SF2=\frac{(PERI)^2}{AREA}\times\frac{1}{4\pi}\times 100$$

ELECTROPHOTOGRAPHIC IMAGE FORMING METHOD AND APPARATUS

BACKGROUND OF THE INVENTION

1. Field of the Invention

The present invention relates to an electrophotographic image forming apparatus and an electrophotographic image forming method, and more particularly to an electrophotographic image forming apparatus and an electrophotographic image forming method, which produce images using an intermediate transfer medium.

2. Discussion of the Background

Recently, electrophotographic image forming apparatuses (such as copiers, printers and facsimile machines) capable of forming multi color images or full color images have been commercialized. These color image forming apparatuses typically include the following processes:

(1) cyan (C), magenta (M), yellow (Y) and black (Bk) toner images are formed on an image bearing member or respective image bearing members such as photoreceptors (toner image forming process);
(2) the color toner images are transferred one by one on an intermediate transfer medium to form a full color toner image on the intermediate transfer medium (primary transfer process);
(3) the full color image is then transferred to a receiving material such as papers (secondary transfer process); and
(4) the full color image is fixed to the receiving material (fixing process); and
(5) the surfaces of the image bearing member and the intermediate transfer medium are cleaned with cleaners (cleaning process)

Recently, tandem-type full color image forming apparatuses, which use four image bearing members for forming C, M, Y and Bk color images, respectively, and an intermediate transfer medium, are widely used because of having image productivity.

In addition, in order to produce high quality images and reduce consumption of energy used for producing toner, polymerization toners, in which toner particles are produced by a polymerization method, are widely used for such color image forming apparatuses.

When images are produced using a toner, a problem in that a toner image on an image bearing member is non-electrostatically (i.e., physically) adhered thereto if a relatively high pressure is applied to the toner image in the primary transfer process occurs, and the toner image remains on the image bearing member without being transferred by an electrostatic force formed by applying a transfer bias. Particularly, since a relatively high pressure is applied to center portions of character images and line images compared to the edge portions thereof, an image omission problem in that the center portions character or line images are omitted is easily caused.

In order to solve this image omission problem on the toner side, it is preferable to reduce the adhesiveness of the toner to the surfaces of the photoreceptor and the intermediate transfer medium used and/or to reduce adhesiveness among toner particles. Specifically, it is preferable to use one or more of the following techniques.

(1) A round toner is used;
(2) A toner including a hard resin is used;
(3) A toner including a large amount of external additive is used; and
(4) A toner including a large external additive is used.

However, when such toners are used, other problems such that the toners have poor cleanability and fixability tend to be caused. In other words, it is difficult to provide a toner which does not cause the image omission problem and has a good combination of cleanability and fixability. Specifically, the content of an external additive in a toner has to be decreased to improve the fixability of the toner, and the content has to be increased to improve the transferability of the toner.

In order to solve the image omission problem on the image forming apparatus side, the following techniques are used.

(1) The pressure (i.e., transfer pressure) applied to a toner image is decreased in the primary transfer process;
(2) The linear velocity of the image bearing member is controlled so as to be differentiated from that of the intermediate transfer medium;
(3) A lubricant is applied to the surface of the image bearing member to decrease the static friction coefficient thereof while no lubricant is applied to the intermediate transfer medium;
(4) An intermediate transfer medium having an adhesive layer thereon is used to improve the toner image transfer efficiency of from an image bearing member to the intermediate transfer medium and the toner image transfer efficiencies in the primary and secondary transfer processes (published unexamined Japanese patent application No. (hereinafter referred to as JP-A) 59-50475);
(5) A friction coefficient decreasing material is included in an intermediate transfer medium to decrease the surface thereof, which results in prevention of occurrence of the image omission problem (JP-A 09-34276);
(6) An elastic layer is formed in an intermediate transfer medium while a lubricant is applied to the surface of the intermediate transfer medium (JP-A 2003-29550); and
(7) A protective layer including a material having good lubricity is formed on the surface of the intermediate transfer medium to improve the toner image transfer efficiencies in the primary and secondary transfer processes (JP-A 02-213881).

When the technique (1) in that the transfer pressure is decreased is used, a transfer nip cannot be stably formed and thereby a uniform transfer bias cannot be applied to the image bearing member and intermediate transfer medium, resulting in occurrence of an undesired image transfer problem in that a toner image cannot be transferred to a predetermined position. Therefore, the transfer pressure cannot be largely decreased, and thereby the image omission problem cannot be perfectly solved by this technique.

When the technique (2) in that the linear velocity of the image bearing member is differentiated from that of the intermediate transfer medium is used, an undesired image transfer problem in that a toner image cannot be transferred to a predetermined position and/or the transferred image is rubbed, resulting in formation of a damaged image occurs. As a result of the present inventor's study, the linear velocity can be differentiated only by about 1%. In this case, the image omission problem cannot be perfectly solved.

When the friction coefficient of the surface of the image bearing member is high, toner particles remaining on the image bearing member cannot be well removed therefrom with a cleaning blade. This cleaning problem is dominantly caused when the toner is a polymerized toner which typically has a high circularity.

In attempting to solve the problems, various techniques have been proposed. However, there is no technique by which occurrence of the problems can be stably prevented for a long period of time.

Because of these reasons, a need exists for an image forming apparatus which can produce high quality images without causing image omission problem in that toner images on an intermediate transfer medium are not well transferred to a receiving material and the cleaning problem in that toner particles remaining on the intermediate transfer medium are not well removed therefrom with a cleaning blade.

SUMMARY OF THE INVENTION

As an aspect of the present invention, an image forming apparatus is provided which includes:

an image bearing member;

a charging device configured to charge a surface of the image bearing member;

a light irradiating device configured to irradiate the charged image bearing member with light to form an electrostatic latent image thereon;

a developing device configured to develop the electrostatic latent image with a developer including a toner to form a toner image thereon;

a primary transfer device configured to transfer the toner image on the image bearing member to a surface of an intermediate transfer medium;

a secondary transfer device configured to transfer the toner image on the intermediate transfer medium to a receiving material;

a first cleaning device configured to clean the surface of the image bearing member;

a second cleaning device configured to clean the surface of the intermediate transfer medium;

a first lubricant application device configured to apply a first lubricant to the surface of the image bearing member such that the surface has a first static friction coefficient; and a second lubricant application device configured to apply a second lubricant, which is different from the first lubricant, to the surface of the intermediate transfer medium such that the surface has a second static friction coefficient higher than the first static friction coefficient.

It is preferable that the second lubricant application device is located on a downstream side from the second cleaning device and on an upstream side from the primary transfer device relative to the rotation direction of the intermediate transfer medium, and the second lubricant includes a particulate lubricant while the second lubricant application device has a blade which is contacted with the surface of the intermediate transfer medium so as to counter the surface to control the coating weight of the second lubricant.

It is preferable that the first static friction coefficient is not greater than 0.25 and the second static friction coefficient is from 0.30 to 0.45.

Another aspect of the present invention, an image forming method is provided which includes:

applying a first lubricant to a surface of an image bearing member such that the surface of the image bearing member has a first static friction coefficient;

applying a second lubricant to a surface of an intermediate transfer medium such that the surface of the intermediate transfer medium has a second static friction coefficient higher than the first static friction coefficient;

forming a toner image on the surface of the image bearing member;

transferring the toner image on the image bearing member to the surface of the intermediate transfer medium; and then transferring the toner image on the intermediate transfer medium to a receiving material.

These and other objects, features and advantages of the present invention will become apparent upon consideration of the following description of the preferred embodiments of the present invention taken in conjunction with the accompanying drawings.

DETAILED DESCRIPTION OF THE INVENTION

Figure 1:
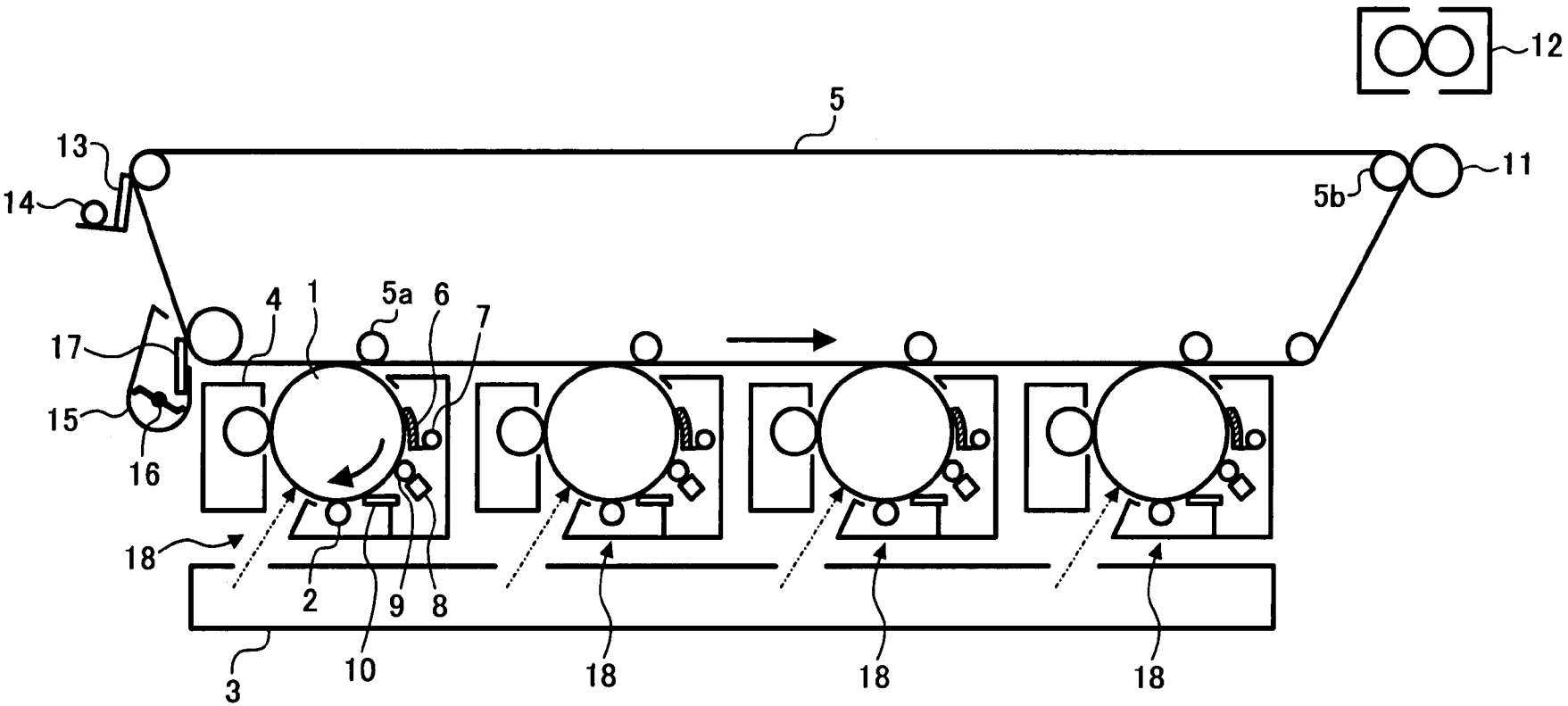
FIG. 1 is a schematic view illustrating an example of the image forming apparatus of the present invention.

As a result of the present inventor's study, it is preferable that the surface of the image bearing member has a friction coefficient of not greater than 0.25 and the surface of the intermediate transfer medium has a friction coefficient of from 0.30 to 0.45 to prevent occurrence of the image omission problem. In this case, the toner particles on the image bearing member and intermediate transfer medium can be well removed therefrom.

Zinc stearate has been used as a good lubricant. By coating zinc stearate on the surface of a material (such as image bearing members and intermediate transfer media), the friction coefficient of the surface of the material can be decreased. In this case, the static friction coefficient is saturated at about 0.15 when the coating weight is changed. Therefore, zinc stearate can be preferably used for image bearing members. However, when zinc stearate is coated on the surface of intermediate transfer media, the friction coefficient of the surface is excessively decreased, and thereby the image omission problem tends to occur.

By controlling the coating weight of zinc stearate, the friction coefficient can be controlled so as to fall in the preferable range mentioned above. Zinc stearate is typically applied on the surface of a material by a method including scraping zinc stearate with a brush and then coating the zinc stearate on the surface using the brush. However, it is difficult to stably control the friction coefficient to fall in the range by such a method. Specifically, even when the pressure at which the brush is applied to zinc stearate is changed to decrease the amount of zinc stearate scraped with the brush, it is difficult to control the friction coefficient to fall in the preferable range. This is because the friction coefficient of a material rapidly changes in this range (i.e., from 0.30 to 0.45) when the coating amount of zinc stearate is slightly changed.

Even when a constant amount of zinc stearate can be applied and thereby the friction coefficient can be controlled to fall in the preferable range, the friction coefficient is increased if images with a high image area proportion are produced. This is because the amount of toner particles remaining on the surface of the image bearing member increases and thereby the amount of zinc stearate, which is present on the surface and which is disposed of together with the residual toner particles in the cleaning process is increased, resulting in increase of the friction coefficient of the surface.

Since various kinds of images are produced by electrophotographic image forming apparatuses, the weight of zinc stearate coated on an image bearing member or an intermediate transfer medium is determined assuming that an average amount of toner particles remain on the surface of the image bearing member or intermediate transfer media. Therefore, when images with a different image area proportion are produced, the friction coefficient widely changes, resulting in occurrence of the image omission problem mentioned above and a cleaning problem in that residual toner particles cannot be well removed.

In the present invention, different lubricants are applied to the surfaces of the image bearing member and the intermediate transfer medium such that the static friction coefficient of the image bearing member is lower than that of the intermediate transfer medium. By using this technique, the image omission problem can be solved without causing the cleaning problem.

The image forming apparatus of the present invention will be explained referring to drawings.

At first, the configuration and image forming operations of an example of the image forming apparatus of the present invention will be explained referring to FIG. 1.

Referring to FIG. 1, numeral 3 denotes an optical writing unit which serves as light irradiating device and which converts color image data, which have been sent from an image reading section, to light signals to perform optical writing according to the light signals. For example, the optical writing unit 3 is a light scanning device in which a laser beam emitted from a laser light source is subjected to deflection-scanning using a polygon mirror and the scanned laser light beam is guided to the surface of a photoreceptor drum 1, which serves as an image bearing member and which is previously charged with a charging device 2, via a constant speed optical scanning system such as fθ lenses to form an electrostatic latent image on the photoreceptor drum 1. In addition, an optical writing device using a LED array; or an optical writing device using a liquid crystal shutter array can also be used as the optical writing unit 3.

As illustrated in FIG. 1, four sets of image forming units 18 are provided in the image forming apparatus to form black (Bk), magenta (M), cyan (C) and yellow (Y) images. Each of the image forming units 18 include the photoreceptor drum 1, which rotates clockwise, and electrophotographic image forming devices such as the charging device 2, a developing device 4, and a cleaning blade 6, which are provided around the photoreceptor drum 1. In addition, an intermediate transfer medium 5 is provided over the image forming units 18. Since the image forming operations of the four sets of image forming units are the same, the image forming operations of one of the image forming units (a black image forming unit) 18 will be explained.

When formation of an image is ordered, the photoreceptor drum 1 is charged with the charging device 2 and the optical writing unit 3 irradiates the charged photoreceptor drum 1 with light including Bk image data. Thus, an electrostatic latent image corresponding to the Bk image data (hereinafter sometimes referred to as a Bk electrostatic latent image) is formed on the photoreceptor drum 1. The developing device 4 develops the Bk electrostatic latent image with a developer including a black toner to form a Bk toner image on the photoreceptor drum 1. The Bk toner image on the photoreceptor drum 1 is transferred to the intermediate transfer medium 5, which is rotated at the same speed as that of the photoreceptor drum 1, at a point in which the photoreceptor drum 1 is contacted with the intermediate transfer medium 5. This transfer operation is hereinafter referred to as a primary transferring operation.

After the primary transferring operation, toner particles remaining on the photoreceptor drum 1 are removed therefrom by a pre-cleaning discharger (not shown) and the cleaning blade 6 serving as a first cleaning device. The toner particles thus removed are discharged from the image forming unit 18 with a first waste toner feeding screw 7.

In this example of the image forming apparatus, a lubricant is applied to the surface of the photoreceptor drum 1 after the cleaning operation mentioned above is completed. Specifically, a brush 9 scratches a solid lubricant 8 and applies the lubricant to the surface of the photoreceptor drum 1. The thus applied lubricant is smoothed with a blade 10.

Similarly to the Bk image forming operation mentioned above, other color (C, M and Y) image forming operations are performed one by one. Thus, four color toner images are formed on the intermediate transfer medium 5, resulting in formation of a full color toner image on the intermediate transfer medium 5. In this regard, a full color image can be formed using three color toners C, M and Y.

The intermediate transfer medium 5 includes an endless belt, which is counterclockwise rotated by a driving motor while tightly stretched by a driving roller, a primary transfer bias roller 5*a*, a secondary transfer bias roller 5*b* and plural driven rollers. When the toner image on the photoreceptor drum 1 is transferred to the intermediate transfer medium 5, a predetermined bias is applied to the primary transfer bias roller 5*a*. By performing four primary transfer operations (i.e., Bk, C, M and Y toner image transfer operations), a full color toner image is formed on the intermediate transfer medium 5.

All the color toner images on the intermediate transfer medium 5, which constitute the full color image, are then transferred on a receiving material at the same time at a nip between the secondary transfer bias roller 5*a* and a secondary transfer roller 11. Thus, the secondary transfer operation is performed. The full color toner image borne on the receiving material is then fixed by a fixing device 12, and the receiving material bearing a fixed full color toner image is discharged from the main body of the image forming apparatus.

Toner particles remaining on the intermediate transfer medium 5 are removed therefrom by an intermediate transfer medium cleaning blade 13 (serving as a second cleaning device), and the collected toner particles are discharged from the image forming unit by a second waste toner feeding screw 14.

In this example, a lubricant is applied to the surface of the intermediate transfer medium 5 after the cleaning operation using the cleaning blade 13. The lubricant application device includes a lubricant case 15 containing, for example, a lubricant powder. The lubricant powder is agitated by an agitator 16 so as to be applied on the surface of the intermediate transfer medium 5. The thus applied lubricant powder is smoothed with a second lubricant application blade 17 to form a lubricant layer having a considerably uniform thickness.

Hereinbefore, the configuration and operations of a tandem-type image forming apparatus have been explained. In the primary transfer process, the color toner images on the photoreceptor drums 1 are transferred to the intermediate transfer medium 5. In this case, the transfer efficiency of the toner images is preferably not less than 90%. However, even when the transfer efficiency is not less than 90%, an image omission problem in that a micro portion of a toner image remains on the photoreceptor drum 1 without being transferred to the intermediate transfer medium 5 can be caused.

Whether or not such an image omission problem is caused depends on the following mechanical factors:

(1) the pressure applied to the primary transfer nip;

(2) the hardness of the photoreceptor drum 1;

(3) the conditions (such as surface roughness) of surface of the photoreceptor drum 1;

(4) the hardness of the intermediate transfer medium 5;
(5) the thickness of the intermediate transfer medium 5;
(6) the conditions of the contact point between the photoreceptor drum 1 and the intermediate transfer medium 5;
(7) the conditions (such as surface roughness) of surface of the intermediate transfer medium 5; etc.

In other words, whether or not such an image omission problem is caused is hardly influenced by electric factors such as the transfer bias, and volume resistivity of the intermediate transfer medium 5 and the secondary transfer bias roller 5*b*. Therefore, the reason why the image omission problem occurs is considered to be that toner particles are aggregated by the stresses (such as pressure applied to the toner particles in the transfer process) and the aggregated toner particles are adhered to the surface of the photoreceptor drum by an adhesive force greater than the electrostatic force applied to the toner image in the transfer process.

Therefore, in order to prevent occurrence of the image omission problem, it is preferable to decrease the adhesiveness of the toner to the photoreceptor while increasing the adhesiveness thereof to the intermediate transfer medium. The adhesiveness of a toner to an image bearing member such as photoreceptors and intermediate transfer media can be decreased (or increased) by decreasing (increasing) the friction coefficient of surface of the image bearing member. Therefore, in order to prevent occurrence of the image omission problem, it is preferable that the friction coefficient of surface of the photoreceptor drum 1 is decreased while the friction coefficient of surface of the intermediate transfer medium is increased.

However, when the static friction coefficient of a toner image bearing member (such as photoreceptors and intermediate transfer media) is excessively increased, the adhesiveness of toner particles to the toner image bearing member is increased, and thereby a cleaning problem in that toner particles remaining on a toner image bearing member cannot be well removed with a cleaning blade is caused. In addition, when a polymerization toner, which typically has a spherical form, is used, this problem is dominantly caused. If the pressure applied to a cleaning blade is increased to prevent occurrence of these cleaning problems, the cleaning blade is seriously abraded after long repeated use, resulting in deterioration of the cleaning ability of the cleaning blade. If the contact angle of the cleaning blade against the toner image bearing member is increased, a problem in that the tip of the cleaning blade is reversed (i.e., turned over), and thereby residual toner particles cannot be well removed occurs. Therefore, it is preferable to decrease the friction coefficient of the toner image bearing members to some extent. In the image forming apparatus of the present invention, the friction coefficient of the toner image bearing members is decreased by applying a lubricant thereto.

When the photoreceptor drum 1 has a static friction coefficient of not greater than 0.25, the photoreceptor drum 1 has good blade cleaning property. In contrast, when the intermediate transfer medium 5, which has an endless belt form, has a static friction coefficient of not greater than 0.45, the intermediate transfer medium has good blade cleaning property.

The toner for use in the image forming apparatus of the present invention preferably has a volume average particle diameter (Dv) of from 3 to 8 μm in order to produce high definition images having a resolution of not less than 600 dots per 25.4 mm (i.e., 600 dpi (dot per inches)). In addition, the ratio (Dv/Dn) of the volume average particle diameter (Dv) to the number average particle diameter (Dn) of the toner is preferably from 1.00 to 1.40. In this regard, as the ratio (Dv/Dn) approaches 1.00, the toner has a sharper particle diameter distribution. When the toner has a sharp particle diameter distribution, the toner particles have considerably uniform charge quantity distribution, and thereby high quality images without background fouling can be produced and the toner image transfer rate can be enhanced when an electrostatic transfer method is used.

The volume average particle diameter (Dv), number average particle diameter (Dn) and particle diameter distribution of a toner can be determined using an instrument COULTER COUNTER TAII or MULTISIZER II from Coulter Electronics Inc.

The toner for use in the image forming apparatus of the present invention preferably has a shape factor SF-1 of from 100 to 180 and another shape factor SF-2 of from 100 to 180.

Figure 3A:
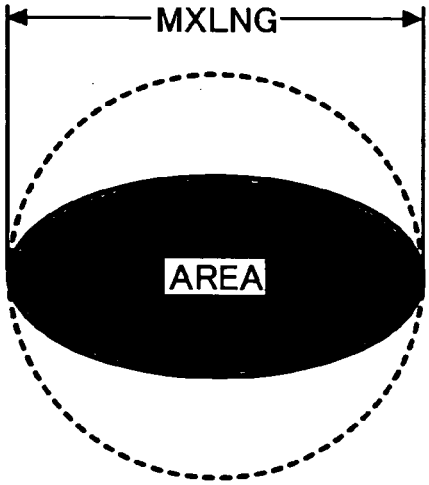
FIGS. 3A and 3B are schematic views for explaining how to determine the shape factors SF-1 and SF-2 of toner.
Figure 3B:
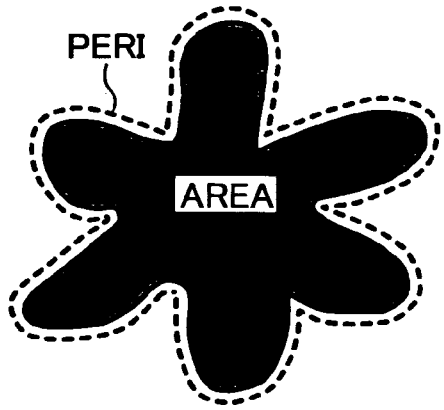
Figure 4A:
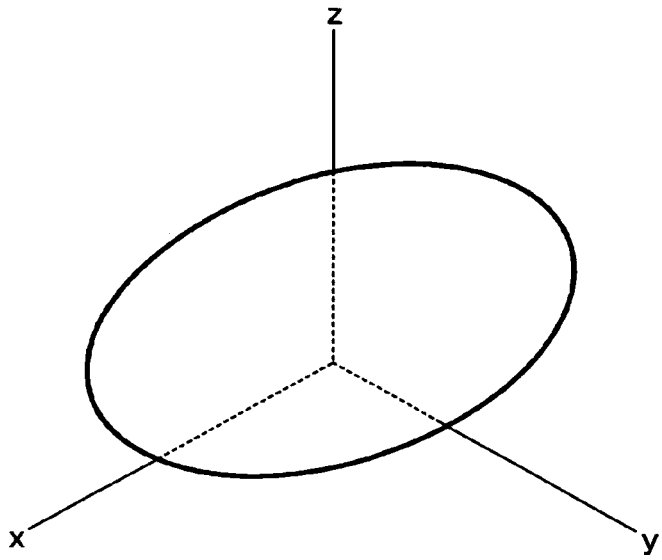
FIGS. 4A-4C are schematic views for explaining the major axis diameter (r1), minor axis diameter (r2) and thickness (r3) of a toner particle.
Figure 4B:
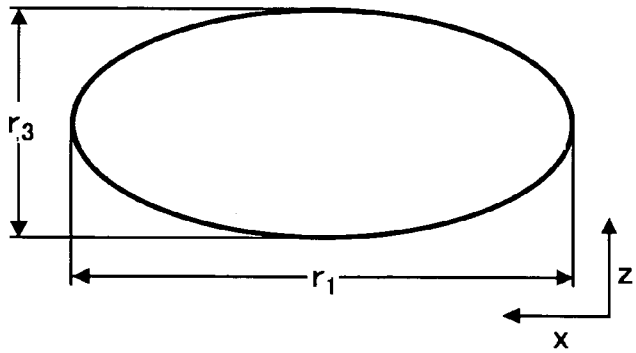
Figure 4C:
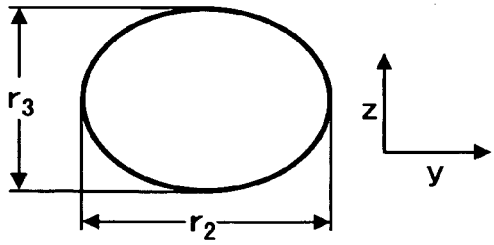

FIGS. 3A and 3B are schematic views for explaining the shape factors SF-1 and SF-2, respectively.

As illustrated in FIG. 3A, the shape factor SF-1 represents the degree of the roundness of a toner and is defined by the following equation (1):

$$SF\text{-}1=\{(MXLNG)^2/(\text{AREA})\}\times(100\pi/4) \quad (1)$$

wherein MXLNG represents a diameter of the circle circumscribing the image of a toner particle, which image is obtained by observing the toner particle with a microscope; and AREA represents the area of the image.

When the SF-1 is 100, the toner particle has a true spherical form. In this case, the toner particles contact the other toner particles and the photoreceptor serving as an image bearing member at one point. Therefore, the adhesiveness of the toner particles to the other toner particles and the photoreceptor decreases, resulting in increase of the fluidity of the toner particles and the transferability of the toner. When the SF-1 is too large, the toner particles have irregular forms and thereby the toner has poor developability and poor transferability.

As illustrated in FIG. 3B, the shape factor SF-2 represents the degree of the concavity and convexity of a toner particle, and is defined by the following equation (2):

$$SF\text{-}2=\{(PERI)^2/(\text{AREA})\}\times(100/4\pi) \quad (2)$$

wherein PERI represents the peripheral length of the image of a toner particle observed by a microscope; and AREA represents the area of the image.

When the SF-2 approaches 100, the toner particles have a smooth surface (i.e., the toner has few concavity and convexity). It is preferable for a toner to have a slightly roughened surface because the toner has good cleanability. However, when the SF-2 is too large (i.e., the toner particles are seriously roughened), a toner scattering problem in that toner particles are scattered around a toner image is caused, resulting in deterioration of the toner image qualities.

The toner for use in the image forming apparatus of the present invention is prepared by, for example, the following polymerization method, but is not limited thereto.

The polymerization method typically includes the following processes (1)-(5).

(1) At first, a colorant, an unmodified polyester resin, a polyester prepolymer having a nitrogen-containing functional group (such as isocyanate groups), and a release agent are dissolved or dispersed in a volatile organic solvent optionally together with other additives (such as charge controlling agents) to prepare a toner constituent mixture liquid (i.e., an oil phase liquid). In order to decrease the viscosity of the oil phase liquid, i.e., in order to easily perform emulsification, volatile solvents which can dissolve the resin and prepolymer used are preferably used. The volatile solvents preferably have a boiling point lower than 100° C. so as to be easily removed after the granulating process.

Specific examples of the volatile solvents include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. These solvents can be used alone or in combination. In particular, aromatic solvents such as toluene and xylene, and halogenated hydrocarbons such as methylene chloride, 1,2-dichloroethane, chloroform and carbon tetrachloride are preferably used.

The added amount of the organic solvent is generally from 0 to 300 parts, preferably from 0 to 100 parts and more preferably from 25 to 70 parts by weight, per 100 parts by weight of the prepolymer (A). When a solvent is used, the solvent is removed after the extension and/or crosslinking reaction of the prepolymer under normal pressure or a reduced pressure.

(2) The thus prepared oil phase liquid is dispersed in an aqueous medium using the below-mentioned dispersing method.

Suitable aqueous media include water. In addition, other solvents which can be mixed with water can be added to water. Specific examples of such solvents include alcohols such as methanol, isopropanol, and ethylene glycol; dimethylformamide, tetrahydrofuran, cellosolves such as methyl cellosolve, lower ketones such as acetone and methyl ethyl ketone, etc.

In the dispersing process, the weight ratio of the toner constituent mixture liquid (i.e., the oil phase liquid) including a prepolymer and other toner constituents to the aqueous medium is generally from 100/50 to 100/2000, and preferably from 100/100 to 100/1000. When the amount of the aqueous medium is too small, the particulate organic material tends not to be well dispersed, and thereby a toner having a desired particle diameter cannot be prepared. In contrast, to use a large amount of aqueous medium is not economical.

The aqueous medium optionally includes a dispersant such as surfactants and particulate resins.

Specific examples of the surfactants include anionic surfactants such as alkylbenzene sulfonic acid salts, α-olefin sulfonic acid salts, and phosphoric acid salts; cationic surfactants such as amine salts (e.g., alkyl amine salts, aminoalcohol fatty acid derivatives, polyamine fatty acid derivatives and imidazoline), and quaternary ammonium salts (e.g., alkyltrimethyl ammonium salts, dialkyldimethyl ammonium salts, alkyldimethyl benzyl ammonium salts, pyridinium salts, alkyl isoquinolinium salts and benzethonium chloride); nonionic surfactants such as fatty acid amide derivatives, polyhydric alcohol derivatives; and ampholytic surfactants such as alanine, dodecyldi(aminoethyl)glycin, di)octylaminoethyle)glycin, and N-alkyl-N,N-dimethylammonium betaine.

By using a fluorine-containing surfactant as the surfactant, good charging properties and good charge rising property can be imparted to the resultant toner.

Specific examples of anionic surfactants having a fluoroalkyl group include fluoroalkyl carboxylic acids having from 2 to 10 carbon atoms and their metal salts, disodium perfluorooctanesulfonylglutamate, sodium 3-{omega-fluoroalkyl (C6-C11)oxy}-1-alkyl(C3-C4) sulfonate, sodium 3-{omega-fluoroalkanoyl(C6-C8)-N-ethylamino}-1-propanesulfonate, fluoroalkyl(C11-C20) carboxylic acids and their metal salts, perfluoroalkylcarboxylic acids and their metal salts, perfluoroalkyl(C4-C12)sulfonate and their metal salts, perfluorooctanesulfonic acid diethanol amides, N-propyl-N-(2-hydroxyethyl)perfluorooctanesulfone amide, perfluoroalkyl(C6-C10)sulfoneamidepropyltrimethylammonium salts, salts of perfluoroalkyl(C6-C10)-N-ethylsulfonyl glycin, monoperfluoroalkyl(C6-C16)ethylphosphates, etc.

Specific examples of the marketed products of such surfactants include SARFRON S-111, S-112 and S-113, which are manufactured by Asahi Glass Co., Ltd.; FLUORAD FC-93, FC-95, FC-98 and FC-129, which are manufactured by Sumitomo 3M Ltd.; UNIDYNE DS-101 and DS-102, which are manufactured by Daikin Industries, Ltd.; MEGAFACE F-110, F-120, F-113, F-191, F-812 and F-833 which are manufactured by Dainippon Ink and Chemicals, Inc.; ECTOP EF-102, 103, 104, 105, 112, 123A, 306A, 501, 201 and 204, which are manufactured by Tohchem Products Co., Ltd.; FUTARGENT F-100 and F150 manufactured by Neos; etc.

Specific examples of the cationic surfactants having a fluoroalkyl group, which can disperse an oil phase including toner constituents in water, include primary, secondary and tertiary aliphatic amines having a fluoroalkyl group, aliphatic quaternary ammonium salts such as perfluoroalkyl(C6-C10)sulfoneamidepropyltrimethylammonium salts, benzalkonium salts, benzetonium chloride, pyridinium salts, imidazolinium salts, etc. Specific examples of the marketed products thereof include SARFRONS-121 (from Asahi Glass Co., Ltd.); FLUORAD FC-135 (from Sumitomo 3M Ltd.); UNIDYNE DS-202 (from Daikin Industries, Ltd.); MEGAFACE F-150 and F-824 (from Dainippon Ink and Chemicals, Inc.); ECTOP EF-132 (from Tohchem Products Co., Ltd.); FUTARGENT F-300 (from Neos); etc.

Suitable particulate resins for use in the toner include any known resins which can be dispersed in an aqueous medium. Specific examples of the resins include thermoplastic and thermosetting resins such as vinyl resins, polyurethane resins, epoxy resins, polyester resins, polyamide resins, polyimide resins, silicon-containing resins, phenolic resins, melamine resins, urea resins, aniline resins, ionomer resins, polycarbonate resins, etc. These resins can be used alone or in combination.

Among these resins, vinyl resins, polyurethane resins, epoxy resins, polyester resins and combinations thereof are preferably used because aqueous dispersions of the resins can be easily prepared. Suitable vinyl resins include homopolymers and copolymers of one or more vinyl monomers. Specific examples of the vinyl resins include styrene-(meth)acrylate copolymers, styrene-butadiene copolymers, (meth) acrylic acid-acrylate copolymers, styrene-acrylonitrile copolymers, styrene-maleic anhydride copolymers, styrene-(meth)acrylate copolymers, etc.

The average particle diameter of the particulate resins is from 5 to 300 nm and preferably from 20 to 200 nm.

In addition, inorganic dispersants which are hardly soluble in water, such as tricalcium phosphate, calcium carbonate, titanium oxide, colloidal silica, and hydroxyapatite can also be used.

Further, it is possible to stably disperse the toner constituent mixture liquid in an aqueous liquid using a polymeric protection colloid. Specific examples of such protection colloids include polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g, acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethylene imine).

In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethyl cellulose and hydroxypropyl cellulose, can also be used as the polymeric protective colloid.

The method for dispersing a toner composition liquid in an aqueous medium is not particularly limited, and known dispersing devices such as low shearing force type dispersing machines, high shearing force type dispersing machines, friction type dispersing machines, high pressure jet type dispersing machines and ultrasonic dispersing machine can be used. In order to prepare a dispersion including particles having an average particle diameter of from 2 to 20 μm, high shearing force type dispersing machines are preferably used.

When high shearing force type dispersing machines are used, the rotation speed of rotors is not particularly limited, but the rotation speed is generally from 1,000 to 30,000 rpm and preferably from 5,000 to 20,000 rpm. In addition, the dispersing time is also not particularly limited, but the dispersing time is generally from 0.1 to 5 minutes for batch dispersing machines. The temperature in the dispersing process is generally 0 to 150° C. (under pressure), and preferably from 40 to 98° C.

(3) At the same time when the emulsion is prepared, an amine (B) is added to the emulsion to be reacted with the polyester prepolymer (A) having an isocyanate group.

This reaction is accompanied with a crosslinking reaction and/or a polymer chain growth reaction. The reaction time, which is determined depending on the reactivity of the isocyanate group of the polyester prepolymer (A) with the amine used, is generally from 10 minutes to 40 hours, and preferably from 2 to 24 hours. The reaction temperature is generally from 0 to 150° C. and preferably from 40 to 98° C. If necessary, known catalysts such as dibutyltin laurate and dioctyltin laurate can be used for the reaction.

(4) After the reaction, the organic solvent included in the emulsion are removed, and then the resultant particles are washed and dried. Thus, toner particles are prepared.

When removing an organic solvent in the emulsion, a method in which the emulsion is heated while strongly agitated so as to have a laminar flow is preferably used. In this case, the resultant toner particles have a spindle form.

When a dispersion stabilizer such as calcium phosphate which can be dissolved in an acid or an alkali is used, the particles are preferably washed after the polymer chain growth reaction and/or crosslinking reaction by a method in which the particles are washed with an acid such as hydrochloric acid to dissolve the dispersant, and then washed with water. In addition, such dispersants can also be removed from the resultant particles by a method using an enzyme.

(5) Next, a charge controlling agent is fixed to the thus prepared toner particles and then a particulate inorganic material (such as silica and titania) serving as an external additive is added thereto. Thus, a toner is prepared by a polymerization method.

This external additive addition operation is performed by any known methods using a mixer.

By using this toner manufacturing method, a toner having a sharp particle diameter distribution can be easily prepared. In addition, by changing the shearing force applied to the emulsion in the organic solvent removing process, the shape of the resultant toner particles can be easily changed from a true circular form to a form like a rugby ball and in addition, the surface conditions of the resultant toner particles can also be changed for a smooth surface to a wrinkled surface.

Specific examples of the materials for use as the lubricant used for controlling the static friction coefficient of the toner image bearing members include natural waxes such as candelilla waxed, carnauba waxes, bees waxes, and montan waxes; synthesized waxes such as hardened castor oil, 12-hydroxy acids and their derivatives, fatty acid amides, fatty acid amides which are substituted at the nitrogen atom, mono- or poly-hydric alcohols, and fatty acid esters; fatty acids such as lauric acid, stearic acid, oleic acid, behenic acid, and palmitic acid; metal soaps such as zinc stearate, lithium stearate, zinc oleate, and lithium hydroxystearate; derivatives of the above-mentioned materials; compounds and complexes including the above-mentioned materials; etc. These materials can be used alone or in combination. It is preferable to use one or more materials which have good affinity for the intermediate transfer medium. When fatty acids are used, fatty acids having 12 or more carbon atoms and a melting point of not lower than 50° C. are preferably used. When the melting point is too low, the lubricant powder has poor high temperature preservability.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

A toner was prepared by mixing 100 parts of toner particles having a volume average particle diameter (Dv) of 4.9 μm and a circularity of 0.965 with 1.5 parts of a hydrophobized silica (HDK H2000 from Wacker) having a primary particle diameter of 15 nm and 0.5 parts of a hydrophobized titania (MT-150AI from Tayca) having a primary particle diameter of 20 nm. Images were produced using the image forming apparatus having the structure as illustrated in FIG. 1 and the above-prepared toner.

The first lubricant application device for coating a first lubricant on the surface of the photoreceptor drum used a stick of zinc stearate and a brush in which hairs made of polyethylene terephthalate and having a weight of 10 denier are transplanted at a density of 30000 pieces/$cm^2$. The stick of zinc stearate was contacted with the brush at a pressure of 5.0 N.

The second lubricant application device for coating a second lubricant on the surface of the intermediate transfer medium used a zinc laurate powder (ZINCLAURATE G from NO F Corporation) which includes particles having a particle diameter of from 0.3 to 1.0 mm as main components but includes particles having a particle diameter of less than 0.3 mm.

The evaluation methods are as follows.

(1) Image Omission

Copies of an original image including character images were produced, and the character images were visually observed to determine whether the character images have omissions. The qualities of the character images were classified into the following 5 grades.

Rank 5: Character images have no omission when visually observed with naked eyes.

Rank 4: Character images have very small omissions, which are barely visible with naked eyes.

Rank 3: Character images have small omissions when visually observed with naked eyes, but the image qualities are still acceptable.

Rank 2: Character images have clear omissions when visually observed with naked eyes and the number of omissions can be determined with naked eyes.

Rank 1: Character images have a number of very clear omissions which can be found by everyone.

(2) Cleaning Property

1) Cleaning Property of Photoreceptor Drum

The image forming apparatus was allowed to settle under an environmental condition of 10° C. and 15% RH such that the apparatus has the same temperature. After the intermediate transfer medium was detached from the photoreceptor drum so that the primary transfer process is not performed, ten black solid toner images with A-4 size, which is located in landscape configuration, were continuously formed while the toner images were cleaned with a cleaning blade. After the tenth toner image passed the cleaning blade, a transparent adhesive tape was adhered to the surface of the cleaned photoreceptor drum to transfer the toner particles remaining on the photoreceptor drum to the adhesive tape. The adhesive tape bearing toner particles thereon was then attached to a white paper, and the unused adhesive tape was also attached to the white paper. The optical densities of the two pieces of tapes were measured with a densitometer (X-RITE 938 from X-Rite Corp.) to determine the density difference (GD1) therebetween.

When the density difference (GD1) is not less than 0.02, the photoreceptor (i.e., the image forming apparatus) is considered to have bad cleaning property.

2) Cleaning Property of Intermediate Transfer Medium

The image forming apparatus was allowed to settle under an environmental condition of 10° C. and 15% RH such that the apparatus has the same temperature. After the secondary transfer roller 11 was detached from the intermediate transfer medium so that the secondary transfer process is not performed, ten black solid toner images with A-4 size, which is located in landscape configuration, were continuously formed while the toner images were cleaned with a cleaning blade. Similarly to the method mentioned above in paragraph 1), the density difference (GD2) was determined.

When the density difference (GD2) is not less than 0.02, the intermediate transfer medium (i.e., the image forming apparatus) is considered to have bad cleaning property.

(3) Static Friction Coefficients of Photoreceptor Drum and Intermediate Transfer Medium One thousand copies of an A-4 size original image, which has an image are a proportion of 5% and which is located in landscape configuration, were continuously produced while the first and second lubricants were applied to the image bearing member and the intermediate transfer medium, respectively. Then the static friction coefficient (μs1) of the photoreceptor drum and the static friction coefficient (μs2) of the intermediate transfer medium were measured by the following Euler belt method.

Figure 2:
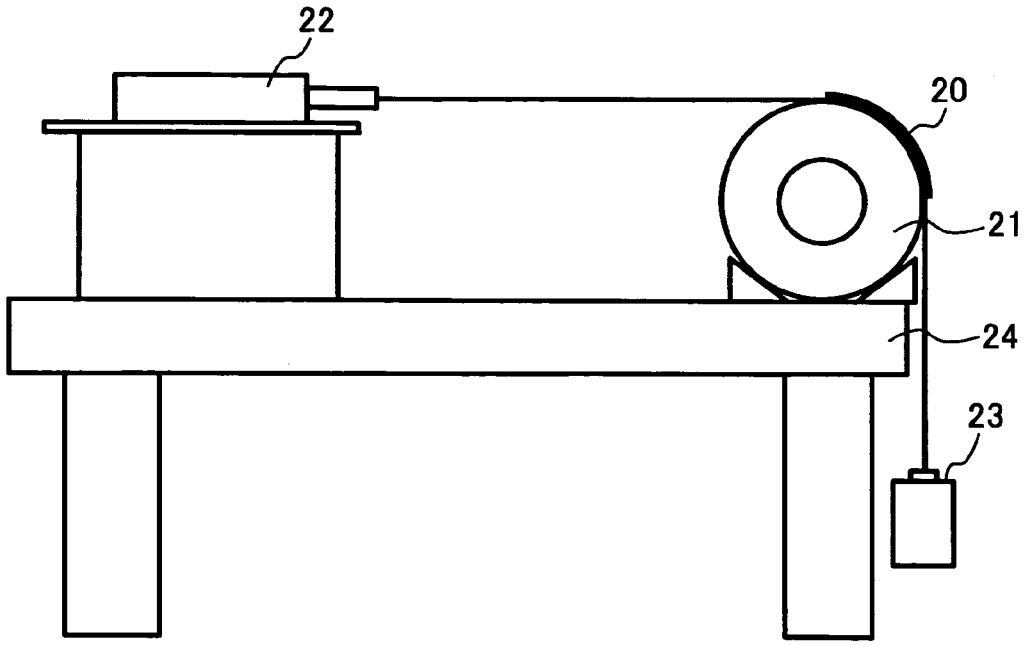
FIG. 2 is a schematic view illustrating a friction coefficient measuring instrument.

As illustrated in FIG. 2, a paper 20 having a belt form is set on an image bearing member 21, the static friction coefficient of which is to be determined. In this regard, the paper 20 is a plain paper having a medium weight, and has a belt form, wherein the paper 20 is cut such that the machine direction of the paper (i.e., the longitudinal direction of a roll of the plain paper manufactured by a paper manufacturing machine) is the same as the longitudinal direction of the belt-form paper. The image bearing member 21 is fixed on a table 24. One end of the paper 20 is connected with a weight 23 (100 g) and the other end of the paper is connected with a force gauge 22 (such as digital pushpull gauges). The paper contacts one fourth of the peripheral surface of the image bearing member 21. Then the paper is pulled slowly with the force gauge. Provided that the paper starts to move at a force of F, the static friction coefficient of the surface of the image bearing member 21 is determined by the following equation:

$$\mu s=(\pi/2)\times ln(F/w)$$

wherein μs is the static friction coefficient of the surface of the image bearing member, F is the measured value of the force, and w is the weight (100 gram-force=0.98 N).

The results are shown in Table 1.

Example 2

The procedure for evaluation in Example 1 was repeated except that the zinc stearate stick was contacted with the brush at a pressure of 6.0 N.

The results are also shown in Table 1.

Example 3

The procedure for evaluation in Example 1 was repeated except that the zinc stearate stick was contacted with the brush at a pressure of 6.0 N, and the zinc laurate powder was replaced with a micronized polyolefin wax ACUMIST B9 from Honey well, which has an average particle diameter of 9 μm.

The results are also shown in Table 1.

Example 4

The procedure for evaluation in Example 1 was repeated except that the zinc stearate stick was contacted with the brush at a pressure of 6.0 N, and the zinc laurate powder was replaced with a particulate lubricant (i.e., a fatty acid amide) ALFLOW H-50F from NO F Corporation.

The results are also shown in Table 1.

Comparative Example 1

The procedure for evaluation in Example 1 was repeated except that the zinc laurate powder was replaced with a calcium stearate powder (CALCIUMSTEARATE G from NOF Corporation).

The results are also shown in Table 1.

Comparative Example 2

The procedure for evaluation in Example 1 was repeated except that the zinc laurate powder was not used and the blade smoothing the zinc laurate was detached from the intermediate transfer medium.

The results are also shown in Table 1.

Comparative Example 3

The procedure for evaluation in Example 1 was repeated except that the zinc stearate stick was contacted with the brush at a pressure of 2.0 N.

The results are also shown in Table 1.

TABLE 1

| | Image omission (rank) | GD1 | GD2 | μs1 | μs2 |
|---|---|---|---|---|---|
| Ex. 1 | 5 | 0.008 | 0.007 | 0.21 | 0.34 |
| Ex. 2 | 4 | 0.007 | 0.008 | 0.13 | 0.32 |
| Ex. 3 | 5 | 0.004 | 0.006 | 0.15 | 0.41 |
| Ex. 4 | 5 | 0.007 | 0.011 | 0.10 | 0.39 |
| Comp. Ex. 1 | 2 | 0.004 | 0.009 | 0.20 | 0.11 |
| Comp. Ex. 2 | 5 | 0.004 | 0.025 | 0.24 | 0.55 |
| Comp. Ex. 3 | 2 | 0.015 | 0.011 | 0.34 | 0.31 |

GD1: Density of toner particles remaining on the photoreceptor
GD2: Density of toner particles remaining on the intermediate transfer medium
μs1: Static friction coefficient of surface of the photoreceptor
μs2: Static friction coefficient of surface of the intermediate transfer medium It is clear from Table 1 that the images produced in Examples 1-4have good to excellent image quality in view of image omission. This is because the static friction coefficients of the photoreceptor and the intermediate transfer medium fall in their preferable ranges, respectively. In contrast, the images produced in Comparative Examples 1 and 3 have omissions because one of the static friction coefficients of the photoreceptor and the intermediate transfer medium does not fall in the preferable range thereof. In Comparative Example 2, a large amount of toner particles remain on the surface of the intermediate transfer medium because the static friction coefficient of the intermediate transfer medium is too high.

As mentioned above, by applying different lubricants to the surfaces of the photoreceptor and the intermediate transfer medium, the static friction coefficients of the surfaces can be controlled such that the static friction coefficients fall the preferable ranges and the static friction coefficient of the photoreceptor is lower than that of the intermediate transfer medium. Therefore, high quality images without omissions and background fouling can be stably produced for a long period of time.

In addition, since a powder can be used as the lubricant for the intermediate transfer medium, various kinds of lubricants can be used therefor.

This document claims priority and contains subject matter related to Japanese Patent Application No. 2005-155474, filed on May 27, 2005, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An image forming apparatus, comprising:

an image bearing member;

a charging device configured to charge a surface of the image bearing member;

a light irradiating device configured to irradiate the charged surface of the image bearing member with light to form an electrostatic latent image on the surface of the image bearing member;

a developing device configured to develop the electrostatic latent image with a developer including a toner to form a toner image thereon;

a primary transfer device configured to transfer the toner image on the image bearing member to a surface of an intermediate transfer medium;

a secondary transfer device configured to transfer the toner image on the intermediate transfer medium to a receiving material;

a first cleaning device configured to clean the surface of the image bearing member;

a second cleaning device configured to clean the surface of the intermediate transfer medium;

a first lubricant application device configured to apply a first lubricant to the surface of the image bearing member such that the surface of the image bearing member has a first static friction coefficient; and a second lubricant application device configured to apply a second lubricant, which is different from the first lubricant, to the surface of the intermediate transfer medium such that the surface of the intermediate transfer medium has a second static friction coefficient higher than the first static friction coefficient, wherein the first static friction coefficient is not greater than 0.25 and the second static friction coefficient is from 0.30 to 0.45.

2. The image forming apparatus according to claim 1, wherein the second lubricant application device is located on a downstream side from the second cleaning device and on an upstream side from the primary transfer device relative to a rotation direction of the intermediate transfer medium, and wherein the second lubricant includes a particulate lubricant and the second lubricant application device has a blade, which is contacted with the surface of the intermediate transfer medium so as to counter the surface of the intermediate transfer medium to coat the second lubricant on the surface of the intermediate transfer medium.

3. The image forming apparatus according to claim 1, wherein the second lubricant application device is configured to apply the second lubricant comprising a particulate polyolefin resin.

4. The image forming apparatus according to claim 1, wherein the second lubricant application device is configured to apply the second lubricant comprising a member selected from the group consisting of fatty acids and fatty acid derivatives, which include 12 or more carbon atoms and which have a melting point of not lower than 50° C.

5. The image forming apparatus according to claim 1, wherein the developing device is configured to develop the electrostatic image with the developer including the toner that has a volume average particle diameter (Dv) of from 3 to 8 μm, and a ratio (Dv/Dn) of the volume average particle diameter (Dv) to a number average particle diameter (Dn) of the toner is from 1.00 to 1.40.

6. The image forming apparatus according to claim 1, wherein the developing device is configured to develop the electrostatic image with the developer including the toner that has a first shape factor SF-1 of from 100 to 180 and a second shape factor SF-2 of from 100 to 180.

7. The image forming apparatus according to claim 1, wherein the developing device is configured to develop the electrostatic image with the developer including the toner that comprises toner particles, which are prepared by a method comprising:

providing a toner composition liquid in which a polyester prepolymer having a nitrogen-containing functional group, a polyester resin, a colorant and a release agent are dissolved or dispersed in an organic solvent; and subjecting the toner composition liquid to at least one of a crosslinking reaction and a molecular chain growth reaction in an aqueous medium to prepare the toner particles.

8. The image forming apparatus according to claim 7, wherein the developing device is configured to develop the electrostatic image with the developer including the toner that has substantially a spherical form.

9. The image forming apparatus according to claim 7, wherein the developing device is configured to develop the electrostatic image with the developer including the toner that satisfies the following relationships:

$$0.5 \leqq (r2/r1) \leqq 1.0, \text{ and } 0.7 \leqq (r3/r2) \leqq 1.0,$$

wherein r1 represents a major axis particle diameter of the toner, r2 represents a minor axis particle diameter of the toner, and r3 represents a thickness of the toner, wherein r3≦r2≦r1.

10. An image forming method, comprising:

applying a first lubricant to a surface of an image bearing member such that the surface of the image bearing member has a first static friction coefficient;

applying a second lubricant, which is different from the first lubricant, to a surface of an intermediate transfer medium such that the surface of the intermediate transfer medium has a second static friction coefficient higher than the first static friction coefficient;

forming a toner image on the surface of the image bearing member;

transferring the toner image on the image bearing member to the surface of the intermediate transfer medium; and transferring the toner image on the intermediate transfer medium to a receiving material, wherein the first static friction coefficient is not greater than 0.25 and the second static friction coefficient is from 0.30 to 0.45.

11. The image forming method according to claim 10, wherein the step of applying the second lubricant comprises applying the second lubricant comprising a particulate lubricant.

12. The image forming method according to claim 10, wherein the step of applying the second lubricant comprises applying the second lubricant comprising a particulate polyolefin resin.

13. The image forming method according to claim 10, wherein the step of applying the second lubricant comprises applying the second lubricant comprising a member selected from the group consisting of fatty acids and fatty acid derivatives, each of which has 12 or more carbon atoms and which has a melting point of not lower than 50° C.

14. The image forming method according to claim 10, wherein the step of forming the toner image comprises forming the toner image on the surface of the image bearing member using a toner that has a volume average particle diameter (Dv) of from 3 to 8 μm, and a ratio (Dv/Dn) of the volume average particle diameter (Dv) to a number average particle diameter (Dn) of the toner is from 1.00 to 1.40.

15. The image forming method according to claim 10, wherein the step of forming the toner image comprises forming the toner image on the surface of the image bearing member using a toner that has a first shape factor SF-1 of from 100 to 180 and a second shape factor SF-2 of from 100 to 180.

16. The image forming method according to claim 10, wherein the step of forming the toner image comprises forming the toner image on the surface of the image bearing member using a toner that comprises toner particles, which are prepared by a method comprising:

providing a toner composition liquid in which a polyester prepolymer having a nitrogen-containing functional group, a polyester resin, a colorant and a release agent are dissolved or dispersed in an organic solvent; and subjecting the toner composition liquid to at least one of a crosslinking reaction and a molecular chain growth reaction in an aqueous medium to prepare the toner particles.

17. The image forming method according to claim 16, wherein the step of forming the toner image comprises forming the toner image on the surface of the image bearing member using a toner that has substantially a spherical form.

18. The image forming method according to claim 16, wherein the step of forming the toner image comprises forming the toner image on the surface of the image bearing member using a toner that satisfies the following relationships:

$$0.5 \leqq (r2/r1) \leqq 1.0, \text{ and } 0.7 \leqq (r3/r2) \leqq 1.0,$$

wherein r1 represents a major axis particle diameter of the toner, r2 represents a minor axis particle diameter of the toner, and r3 represents a thickness of the toner, wherein r3≦r2≦r1.

19. An image forming apparatus, comprising:

an image bearing member;

an intermediate transfer medium configured to transfer a toner image from the image bearing member to a receiving material;

a first lubricant application device configured to apply a first lubricant on a surface of the image bearing member such that the surface of the image bearing member has a first static friction coefficient; and a second lubricant application device configured to apply a second lubricant on a surface of the intermediate transfer medium, which is different from the first lubricant, such that the surface of the intermediate transfer medium has a second static friction coefficient that is higher than the first static friction coefficient, wherein the first static friction coefficient is not greater than 0.25 and the second static friction coefficient is from 0.30 to 0.45.

* * * * *